United States Patent [19]

Nevo-Hacohen

[11] Patent Number: 4,493,414

[45] Date of Patent: Jan. 15, 1985

[54] CONVEYOR ELEVATOR APPARATUS

[76] Inventor: Jacob I. Nevo-Hacohen, 150 Longwood Ave., Brookline, Mass. 02146

[21] Appl. No.: 549,226

[22] Filed: Nov. 7, 1983

Related U.S. Application Data

[63] Continuation of Ser. No. 284,441, Jul. 17, 1981, abandoned.

[51] Int. Cl.[3] ..... B65G 17/18

[52] U.S. Cl. ..... 198/800; 414/238

[58] Field of Search ..... 198/797–800, 198/778, 603, 326, 328; 414/236–238, 247–249, 250

[56] References Cited

U.S. PATENT DOCUMENTS 1,095,361 5/1914 Seeberger ..... 198/326
2,965,049 12/1960 Rover ..... 198 X/797
3,410,426 11/1968 Fehlmann ..... 414/251
3,447,666 6/1969 Nevo-Hacohen ..... 198/800
3,865,227 2/1975 Kaak ..... 198 X/778

*Primary Examiner*—Joseph E. Valenza
*Assistant Examiner*—Dennis Williamson
*Attorney, Agent, or Firm*—Rines and Rines, Shapiro and Shapiro

[57] ABSTRACT

This disclosure is concerned with improved conveyor elevator apparatus employing closed-loop horizontal main conveyors carrying vehicle-supporting platforms with the aid of followers that track follower channels extending in staggered fashion with the main conveyor channels, and employing novel direction-changing transverse end portions at which auxiliary conveyors engage the followers and insure horizontal stability of the platforms in their vertical travel through the transverse direction-changing end portions.

16 Claims, 13 Drawing Figures

CONVEYOR ELEVATOR APPARATUS

This application is a continuation of U.S. Ser. No. 284,441, filed 7/17/1981, now abandoned.

The present invention relates to conveyor elevator apparatus, being more particularly, though not exclusively, directed to such apparatus useful for the garaging of automotive vehicles and the like and for related purposes.

In my earlier U.S. Pat. Nos. 3,197,045, and 3,447,666, and the references cited therein, systems for alleviating the problem of parking automobiles in confined spaces, such as in large cities and in other areas where space is at a premium, have been proposed, involving elevator conveyor apparatus that enable storage of automobiles within underground or other spaces with ready transportation of the stored vehicle by the conveyor apparatus to an outlet or platform of egress, as needed.

Referring specifically to the type of apparatus disclosed in my said Letters Patents, techniques were developed for achieving both horizontal and vertical stability of the chain-carried platforms for the automobile through the use of follower mechanisms secured to the platform and driven by the main conveyor chains through the principal extent of the continuous conveyor loops and cooperatively stabilized at the direction-changing or end portions of the loops by auxiliary chain or conveyor mechanisms. In the first-named patent it was proposed that the auxiliary chain may be operated by a special drive and therefore can be synchronized with the main chain; or in the form where the auxiliary chain is driven by engagement with the journalling shaft from the platform to the main chain. This construction, however, requires additional drive in the first instance, or quite lengthy auxiliary chain in the second instance. In addition to the cost involved, such engagement with the journalling shaft represented a problem in view of the fact that when the main chain was loaded or partially loaded, the degree of so-called chain-stretching is variable, and the auxiliary chain having less numbers of links and being loaded locally has much less variation of length; similary, less future elongation due to wear. Therefore the problem of smooth engagement at all times still underlies the system.

In particular designs, in accordance with my said prior Letters Patent, the platforms would be secured to the main chain, say, every nine feet, and the follower would ride in its own track. The fact that the auxiliary chain had to be engaged with the follower journalling shaft and the main chain journalling shaft to the platform created the necessity for more "saddle" links (special links) for each of the auxiliary chains. This added considerable cost, as well.

An object of the present invention, accordingly, is to provide a new and improved continuous conveyor elevator system of this character that shall not be subject to the above-described and other disadvantages, but that, to the contrary, is adapted for operation with a much smaller and differently driven auxiliary chain mechanism and configuration.

A further object of the invention is to provide a simplified novel conveyor elevator system of the character described.

Other and further objects will be explained hereinafter and are more particularly pointed out in connection with the appended claims. In summary, however, the invention contemplates from one viewpoint conveyor elevator apparatus having, in combination, a pair of similar substantially co-extensive closed-looped main channels disposed in a pair of spaced substantially parallel planes; a pair of synchronously driven main conveyors disposed to travel along the pair of main channels; a further pair of similar substantially co-extensive closed-loop follower channels disposed in a pair of substantially parallel planes one disposed adjacent to each of the main channels in the space there-between and longitudinally staggered with respect to the main channels; a plurality of spaced horizontally disposed platforms mounted between the pairs of channels and supported near one end of the platforms by attachment to the pair of main conveyors and supported near their other end, through follower means, within and between the pair of follower channels, so that each platform is supported at four points at all times, the longitudinally staggered main and follower channels each having a longitudinal section and a transverse direction-changing end portions of their respective loops that incline first at an acute angle and then decline back at a reverse acute angle to the longitudinal sections of the same, with a section of vertical travel through the direction-changing end portion for the platforms carried by the main conveyors; and auxiliary conveyor means disposed adjacent the end portions of the follower channels for engaging the follower means of the platforms entering the said end portions, the length of the auxiliary conveyor means being sufficient always to contact at least two such platforms to enable the horizontal stability of the said platforms as they travel the said section of vertical travel. Preferred details of construction and best mode embodiments are hereinafter presented.

The invention will now be described in connection with the accompanying drawings FIG. 1 of which is a diagrammatic longitudinal section of a preferred embodiment illustrating the over-all system of the invention;

Figure 1:
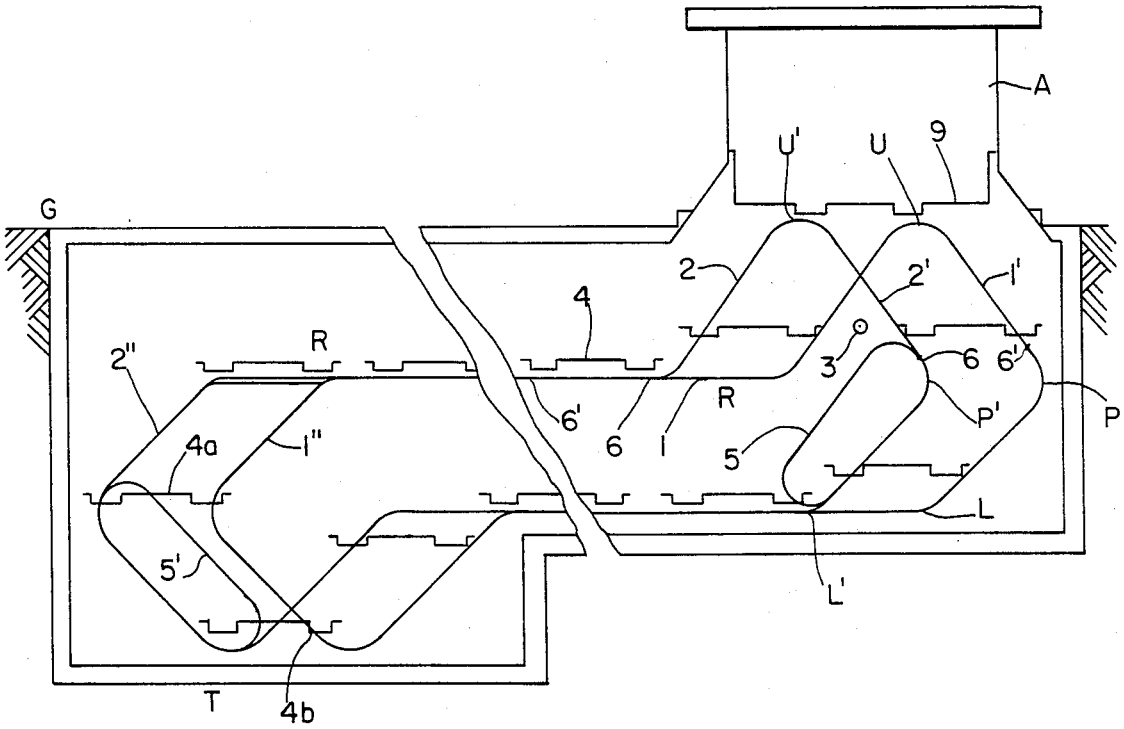
FIG. 1A is a view similar to FIG. 1 but showing actual constructional details.
FIG. 1B is a fragmentary view illustrating details of the main drive for the main chain of FIGS. 1 and 1A.
Figure 2:
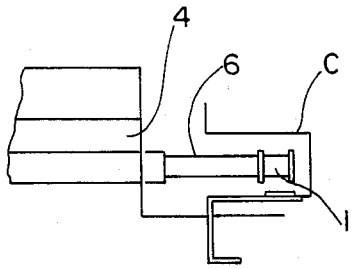
FIG. 2 is a transverse section illustrating the main-chain channel.
Figures 1A, 1B:
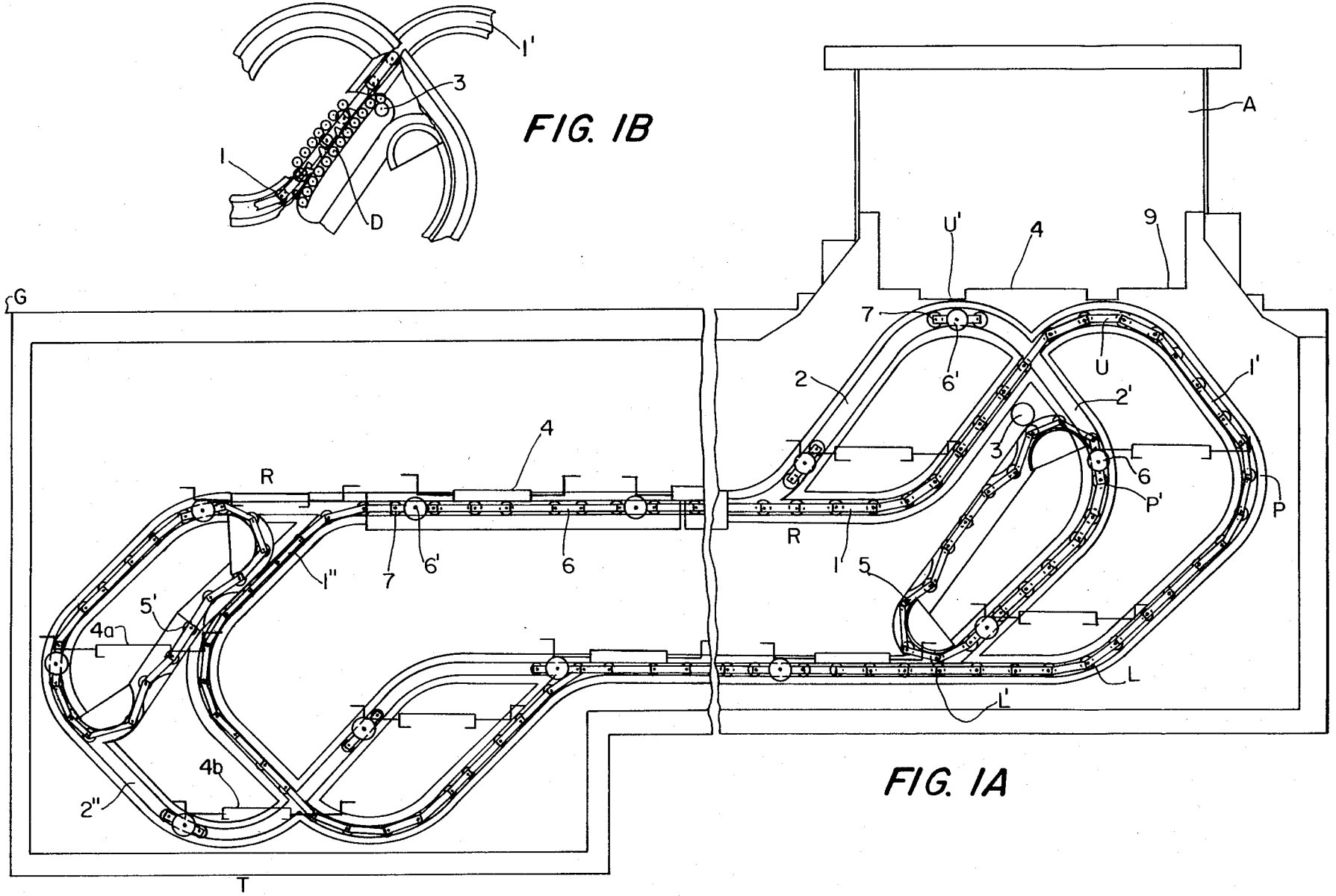

Referring to FIGS. 1 and 1A, the main car platform-carrying chain is shown at 1 disposed underground G and constructed in the form of a long longitudinally extending conveyor loop having a right-hand direction-changing end or terminal portion 1' powered from a drive shaft 3, and an oppositely disposed left-hand direction-changing end 1''. The chain 1 is carried in a channel, a transverse cross section of which is shown at C in FIG. 2. A preferred caterpillar chain drive being shown at D in FIG. 1B engages the main car platform-carrying chain 1 and has the drive shaft 3 connected to a speed reducer and motor, now shown, as is well known.

Whereas in accordance with my earlier Letters Patent, a pair of auxiliary chains extending over a substantial portion of the loop was provided, in accordance with the present invention, the auxiliary chains may be relatively short and may be disposed solely at regions of the direction-changing ends of the loop, as illustrated at 5 and 5', respectively. These are disposed near the right and left-hand end or terminal direction-changing loop portions 1' and 1'' of the main chains 1. The pair of auxiliary chains 5 (one behind the other) are shown disposed inside the loop 1'; and, in this version, the pair of auxiliary chains 5' are shown disposed external to the end loop 1'' at the left-hand end of the main conveyor chains 1.

Figure 3:
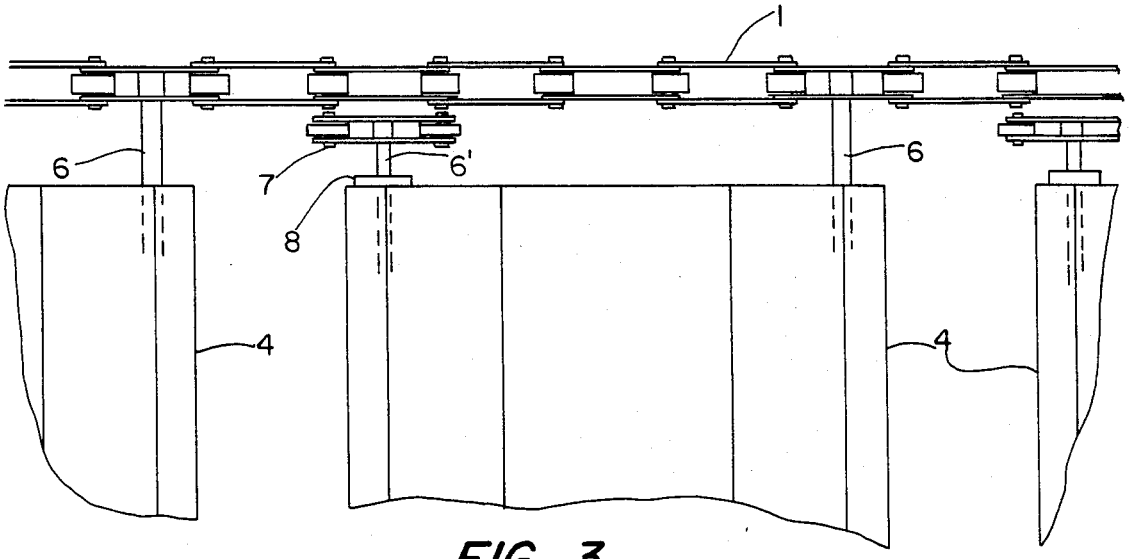
FIG. 3 is a fragmentary top elevation, upon an enlarged scale, of the side of the car-carrying platforms journalled to the main chain.

The car-carrying platforms 4 are illustrated as carried by main chains 1—actually a pair of similar closed-loop main chains in a pair of spaced substantially parallel plane channels, one behind the other in FIGS. 1 and 1A, and synchronously driven. Journalling shafts 6 are connected to support the right-hand side of the platform 4, as shown in FIGS. 1 and 1A. A more detailed view of this construction is illustrated in FIG. 3 wherein the platform 4 has its journalling shaft 6 extending from one side thereof to connect with the main chain 1. At the other side of platform 4, a similar but somewhat shorter shaft 6' extends on the same side and connects with a follower multi-roller link 7. The multi-roller link 7 of FIG. 3 is to engage a closed loop follower track 2, FIGS. 1 and 1A (actually a substantially parallel pair of follower channels), having a right-hand end portion 2' within and adjacent the loop or end portion 1' of the main chain 1 and its channel; and a left-hand loop portion 2'' shown external to the left-hand loop or terminal portion 1'' of the main chain 1 and its channel. The follower channels are thus disposed in the space between the main chain channels and are longitudinally staggered with respect to the same.

Figure 4:
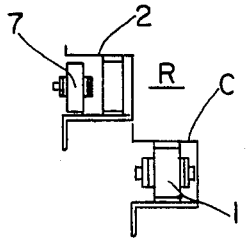
FIGS. 4 and 4A are respective sections of the follower and main-chain channel guidance at the intersection of the main and follower channels and in between the intersection regions.
Figure 4A:
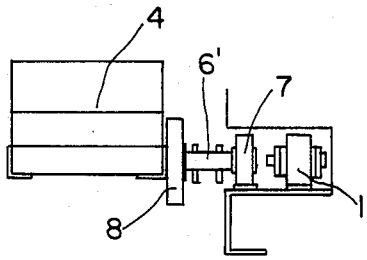

The follower multiple roller link 7 is engaged within this follower channel 2, the cross section of which is as shown in FIG. 4 at the regions R (FIGS. 1 and 1A) of intersection of the main and follower channels C and 2 and along the follower channel ends 2' and 2''. The cross section shown at FIG. 4*a*, however, is the normal cross section between the regions R along the main length of the conveyor 1.

It will now be described how the car-carrying horizontally disposed platforms 4, which are shown in the form of a double-trough construction to receive the automotive vehicle wheels, are supported in the course of their travel. Each platform 4 is supported at four points, one at each right-hand end by the before-mentioned journalling shaft 6 which is connected to the main chain 1; and at the left side of the platform, at opposite ends by journalling shaft 6' connected to the follower 7. The follower 7 rides in its track channel and the main chain 1 rides in its track channel; it being understood that what is shown in FIGS. 1 and 1A, as before stated, is mirrored on the other side of the platform, behind what is shown in FIGS. 1 and 1A, providing this four-point support. The platforms are to be carried along the longitudinal (shown horizontal or nearly so) sections of the main and follower channels to their respective transverse direction-changing end portions. Each of these end portions starts with an inclined acute angle portion and then a decline at a reverse acute angle with a section of vertical travel for the platforms.

At the end portions 2' and 2'' of the follower channel 2, the previously mentioned auxiliary direction-changing chain drives 5 and 5' are arranged as follows. The follower track at certain portions has an arrangement for the auxiliary chain track to be incorporated so that at those portions of the follower track, the auxiliary chain is also travelling engaged with the follower journalling shafts 6'. Each such portion of the joint auxiliary chain track and the follower track is made longer than the spacing between successive platforms 4, so that when a follower 7 of a platform is travelling at or is located at a vertical travel section of the track (see P in FIG. 1), the auxiliary chain which engages with the follower journalling shaft at that section is engaged with another follower journalling shaft of a platform which is travelling on or located on a horizontal section or in a sloped acute angle section of track. The position of the latter platform geometrically stable, being governed by the track confinement and by the main chain. Since the auxiliary chain is compelled to move in synchronism with the latter platform by engagement with its journalling shaft 6', the auxiliary chain stabilizes the horizontal position of the previously-mentioned platform at the vertical section.

Figure 6:
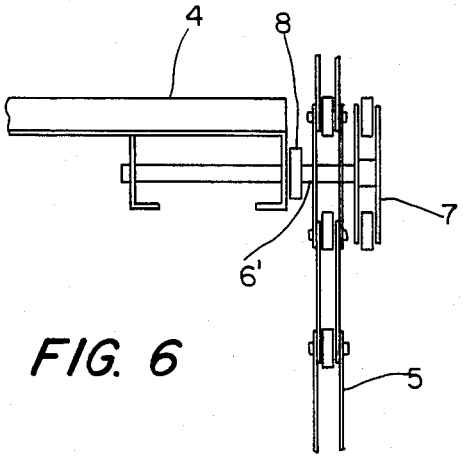
FIGS. 6 and 7 are views similar to FIG. 3 respectively showing the association of the auxiliary chain and the main chain with the platform journalling shafts.
Figure 7:
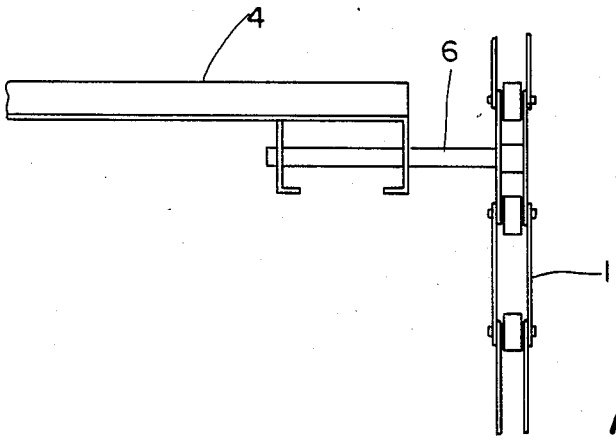

In FIG. 6 the auxiliary chain 5 is shown in association with the journalling shaft 6' and the follower 7; and in FIG. 7, the connection of the journalling shaft 6 to the main chain 1 is more particularly illustrated for the position of FIG. 4.

Figure 5:
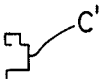
FIG. 5 is a schematic cross section of the channel for the follower and auxiliary chain at the direction-changing regions.

Referring to the left-hand section of FIG. 1, where the auxiliary chain 5' is illustrated adjacent the follower track portion 2'', two platforms 4 are shown being carried in the region between the end loop portions 2'' of the follower track and 1'' of the main drive chain. At the reverse acute angle region where the platform 4, shown at the bottom of FIGS. 1 and 1A, entered the left-hand direction-changing region 1'', labelled T, the cross section of the channel for the follower and auxiliary chain is as represented in the schematic sectional view of FIG. 5. The auxiliary chain 5' is carried in the inner portion of the channel C' and the follower 7, which is connected to the journalling shaft 6', is carried adjacent the same within the channel. Thus, the auxiliary chain 5' handles the journalling shaft 6' of the follower 7 along the region of the follower track and especially in the vertical travel section where it needs to be supported. This is shown at the platform 4*a* on the left-hand side of FIGS. 1 and 1A. While the incline-decline loops 2—2', 1—1' are upward from the horizontal path of the main channel, the loops 2—2'', 1—1'' are in the opposite direction—downward; but in both cases, the platforms are stabilized in the vertical travel section encountered as the direction-changing is effected.

In order to make the vestibule A of FIGS. 1 and 1A as narrow as possible because it takes a space at the street level from the area in front of the main building, steep angles for the tracks have been selected, thus to minimize the size of the vestibule. A 54° angle has been selected for the decline back to the horizontal, with an original acute angle incline of 45°. These angles have been found particularly suited for the construction of FIGS. 1 and 1A, wherein the incline of the main channel of main conveyor chains 1 at the direction-changing right-hand end portion, for example, rises to a vertically displaced crest point U (shown at vestibule A, and also shown horizontally staggered or displaced to the right from the top point U' of the follower channel upward incline, also at the vestibule) and then declines at 1' to a point P substantially in-line with the upper horizontal section of the main channel conveyor 1, much as the follower channel declines to a similar point P'. From points P and P', the main and follower channel direction-changing end portions then incline back toward their respective lower horizontal sections, joining the same at points L and L', substantially vertically aligned below the crest points U and U'. Similar remarks apply to the left-hand opposite direction-changing end portions.

By this construction, savings are incorporated in a number of ways including that the length of the auxiliary chain and its track are very substantially reduced over the techniques of said prior patents. The beforementioned problem of engagement when there is different stretch in the main chain and in the auxiliary chain under different loading conditions is greatly reduced.

As shown, at the top of the terminal loop portions 1' and 2', FIGS. 1 and 1A, the platform 4 passes to an external access region A, as for the loading or unloading of the vehicle. In FIGS. 1 and 1A, walkway platforms 9 in the vestibule A are provided for passengers alighting from their car. When the conveyor is about to travel, these walkways are raised for clear passage.

It should be noted that the sloping configuration of the end loops, as distinguished from a rectangular configuration, enables the shortening of the spacing between neighboring platforms, achieving two advantages; enabling the use of more platforms per given space, and enabling the use of shorter chains that therefore require less cost. A basic feature of this improvement is that the auxiliary chain such as 5, is engaged with two or more neighboring platforms (such as **4*a* and 4*b* of FIGS. 1 and 1A), thus keeping the horizontal position of platform 4*a* when it is in the vertical traveling section of the track (as shown) by the auxiliary chain engaged with platform 4*b* on the sloped track and thus in geometrically stable horizontal position. The auxiliary chain 5 must at such time engage at least two of the follower journalling shafts 6' to provide horizontal stability as the platforms traverse the direction-changing end portion. In addition, the auxiliary chain track does not have to be connected to the horizontal portion of the track, remaining with the sloped portion of the follower track and thereby not requiring an additional saddle link for the journalling shaft to the main chain; or, at most, only one saddle link per some feet of spacing of the follower journalling shaft 6'**.

Figure 8:
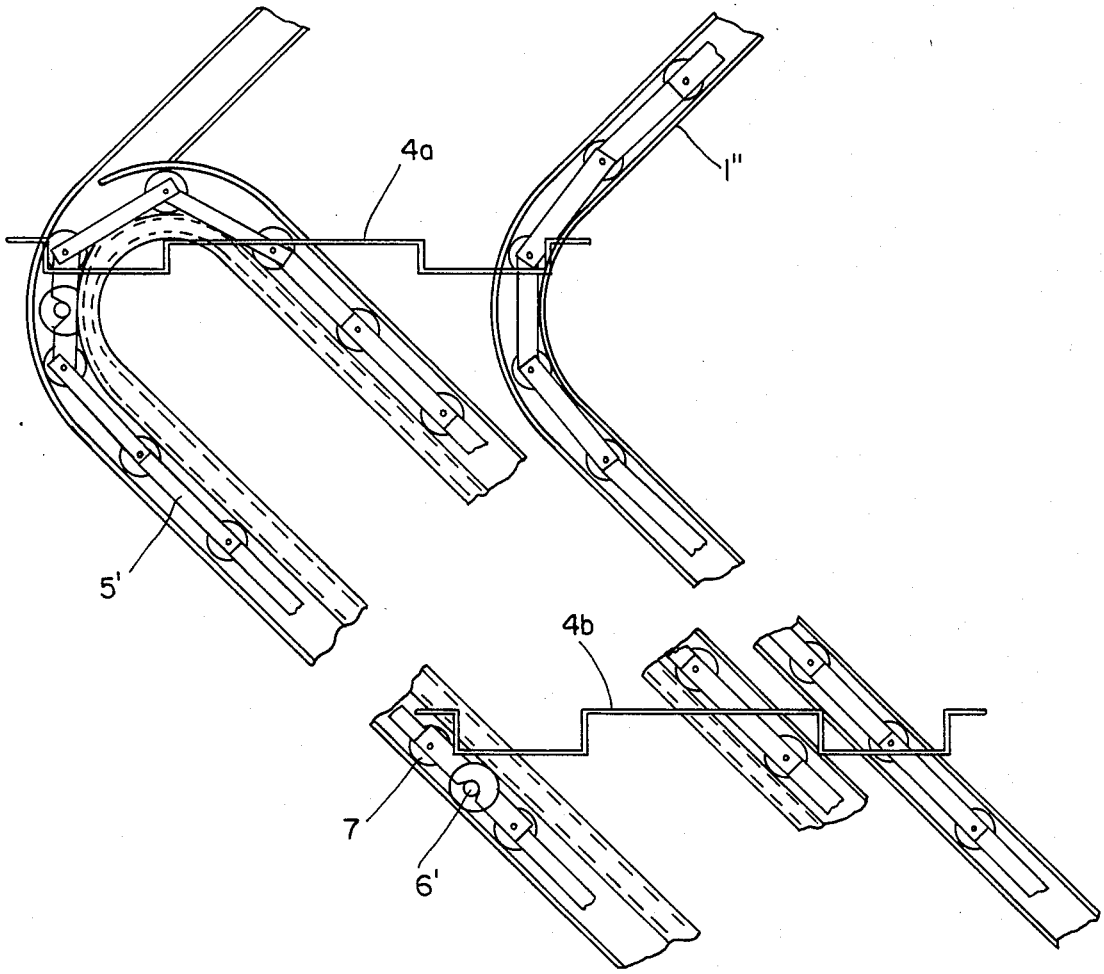
FIG. 8 is an enlarged fragmentary view of a direction-changing section.

FIG. 8 shows the platforms **4*a* and 4*b* of FIGS. 1 and 1A on an enlarged scale. Taken with FIGS. 3 and 6, it shows how the auxiliary chain 5' engages with the follower journalling shaft 6'. The large roller 8 of the follower 7, more particularly shown in FIGS. 3, 4A and 6, but hidden behind the auxiliary chain in FIG. 8**, has a critical job in bridging over the gap in the follower track, necessary to allow the passage of the journalling shaft to the main chain, as described in my said earlier U.S. Pat. No. 3,197,045.

Figure 9:
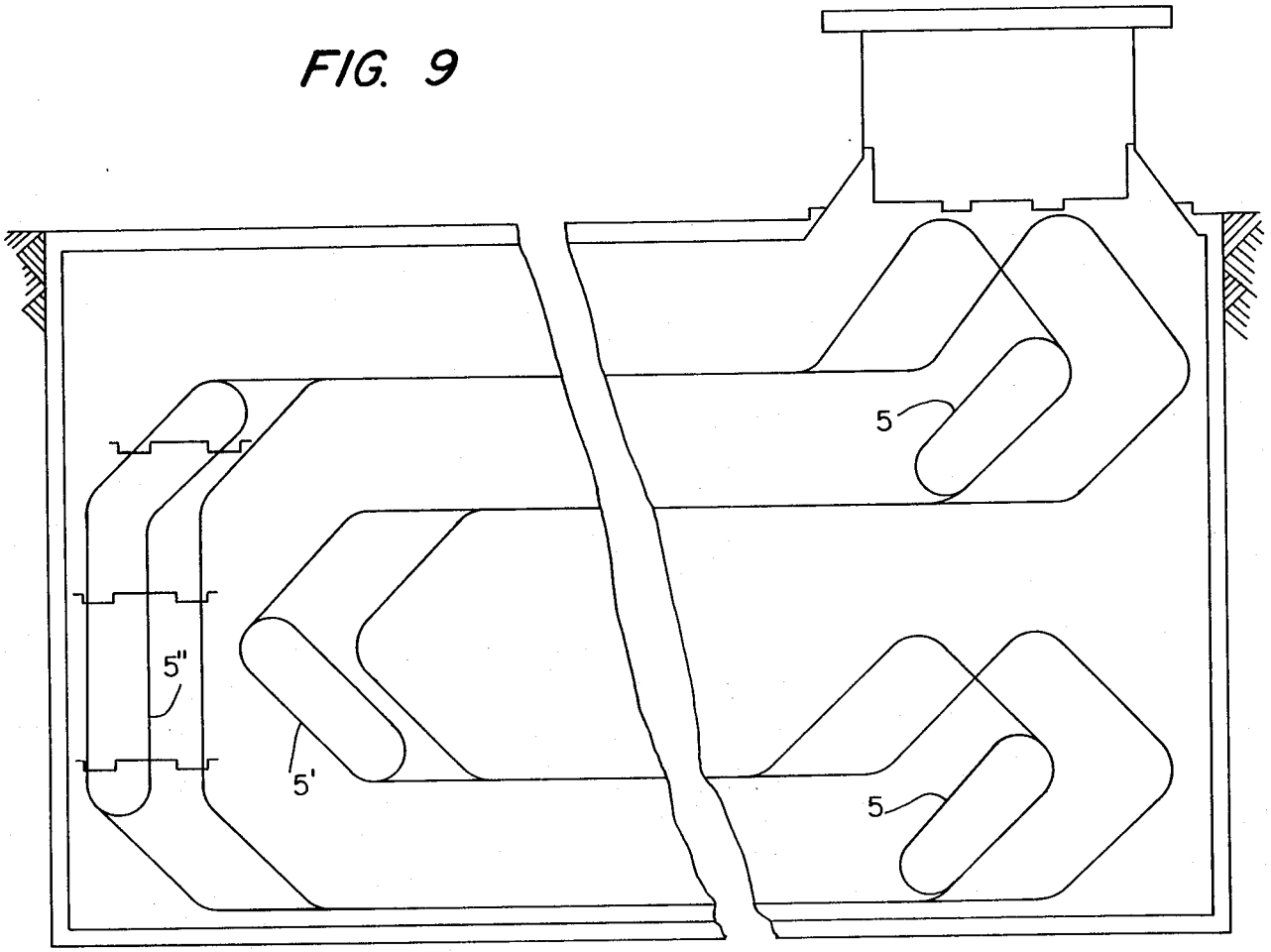
FIG. 9 is a view similar to FIG. 1 of a multi-level modification.
Figure 10:
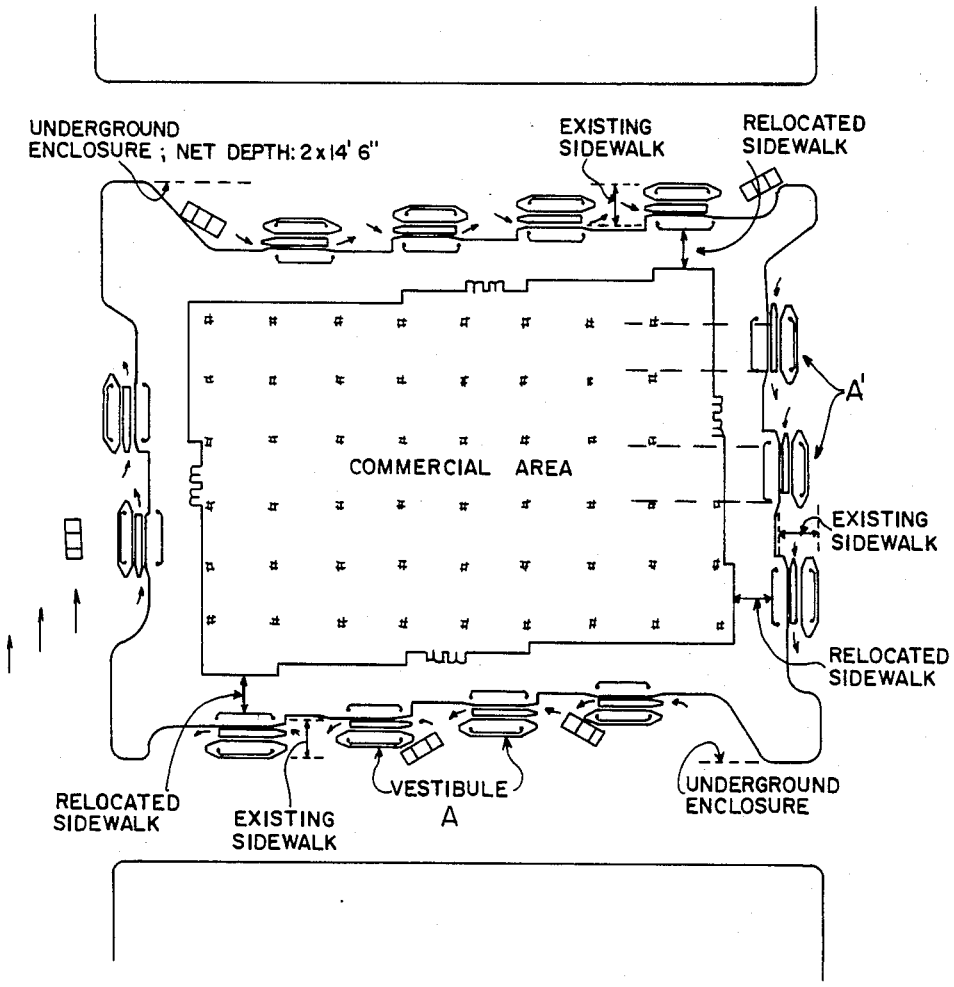
FIG. 10 is a plan view of orthogonally installed systems.

Because of the symmetrical design of the invention, moreover, doubling, tripling and other multiplying of levels is now feasible. FIG. 9 shows this system configuration, for example, for a four-level installation. The multi-level installations need not, however, run in the same direction. In FIG. 10, a plan view of a typical street-access installation is shown with vestibules A, corresponding to those of FIGS. 1 and 1A, for example, being in an upper basement parking space, as an illustration; and vestibules A' being in a lower basement, associated with a similar system, but one oriented orthogonal to that of the upper basement installation.

Further modifications will also occur to those skilled in this art and such are considered to fall within the spirit and scope of the invention as defined in the appended claims.

What is claimed is:

1. In conveyor elevator apparatus having a pair of substantially co-extensive main closed-loop channels and a pair of substantially co-extensive follower closed-loop channels, said pairs of channels being longitudinally staggered, each channel having upper and lower horizontal sections adapted for movement of platforms therealong in opposite horizontal directions, respectively, said main channels receiving main conveyors mounting successively spaced horizontal platforms supported near one end by attachment to the main conveyors and supported near the other end through follower means that ride in said follower channels, and so that each platform is supported at four points at all times, the combination of longitudinally staggered direction-changing transverse end portions at an end of each of the main and follower channels transversely connecting their respective upper and lower horizontal sections, each end portion defining two sloping sections and an adjacent vertical section by which the platforms move transversely between the upper and lower horizontal sections; and a pair of auxiliary conveyor means disposed adjacent said direction-changing end portions of the follower channels, respectively, and engaging the follower means of the platforms at the vertical section and at least one of the sloping sections of each of those end portions so that the auxiliary conveyor means is compelled to move in synchronism with such follower means, the length of the auxiliary conveyor means being less than the length of the adjacent transverse end portions but sufficient always to engage the auxiliary conveyor means with the follower means of at least two platforms, with one such platform at said one of the sloping sections of an end portion when another is at the vertical section thereof, to enable each platform moving along a vertical section of an end portion to remain stable horizontally due to engagement of the auxiliary conveyor means with the follower means of a platform at said sloping sections of that end portion.

2. Conveyor elevator apparatus as claimed in claim 1 and in which there are direction-changing transverse end portions at each end of each of said main and follower channels and in which the end portions of the follower channels are disposed outside the end portions of the main channels at one end thereof and inside the end portions of the main channels at the other end thereof.

3. Conveyor elevator apparatus as claimed in claim 2 and in which the auxiliary conveyor means is disposed between the end portions of the follower and main channels at said one end and inside the end portions of the follower channels at said other end.

4. Conveyor elevator apparatus as claimed in claim 1 and in which said one sloping sections of the end portions slope outwardly of respective horizontal sections of the main and follower channels to join respective vertical sections of the end portions.

5. Conveyor elevator apparatus as claimed in claim 1 and in which said one sloping sections of the end portions slope inwardly from respective vertical sections of the end portions to join respective horizontal sections of the main and follower channels.

6. Conveyor elevator apparatus as claimed in claim 1 and in which each end portion includes a pair of sloping sections that slope outwardly to and inwardly from respective vertical sections.

7. Conveyor elevator apparatus as claimed in claim 1 and in which each end portion includes an incline-decline section extending vertically beyond the upper and lower horizontal sections, said decline constituting a previously recited sloping section of the end portion.

8. Conveyor elevator apparatus as claimed in claim 7 and in which the angle of the incline is of the order of 45° to horizontal and the angle of the decline is of the order of 54° to horizontal.

9. Conveyor elevator apparatus as claimed in claim 7 and in which the incline-decline sections extend upwardly and outwardly from respective upper horizontal sections of the main and follower channels, then extend downwardly and outwardly to join respective vertical sections, and wherein the remaining sloping sections extend downwardly and inwardly from respective vertical sections to join respective lower horizontal sections of said main and follower channels.

10. Conveyor elevator apparatus as claimed in claim 9 and in which the tops of the incline-decline sections of the end portions of the main and follower channels define horizontally spaced points and in which said remaining sloping sections join the respective lower horizontal sections of the main and follower channels at horizontally spaced points that are substantially vertically aligned with corresponding top points.

11. Conveyor elevator apparatus as claimed in claim 7 and in which the incline-decline sections extend downwardly and outwardly from respective lower horizontal sections of the main and follower channels, then extend upwardly and outwardly to join respective vertical sections, and wherein the remaining sloping sections extend upwardly and inwardly from the vertical sections to join respective upper horizontal sections of said main and follower channels.

12. Conveyor elevator apparatus as claimed in claim 11 and in which the bottoms of the incline-decline sections define horizontally spaced bottom points, and in which the remaining sloping sections join the respective upper horizontal sections of said main and follower channels at points that are substantially vertically aligned with corresponding bottom points.

13. Conveyor elevator apparatus as claimed in claim 1 and in which there are direction-changing transverse end portions at each end of each of said main and follower channels, each including an incline-decline section, the incline-decline sections extending from and above respective upper horizontal channel sections at one end thereof and extending from and below respective lower horizontal channel sections at the opposite end thereof, the declines at said one end and the inclines at said opposite end constituting previously recited sloping sections.

14. Conveyor elevator apparatus as claimed in claim 13 and in which, at said one end of the main and follower channels, the tops of the incline-decline sections of the main and follower channels, respectively, define horizontally spaced top points, and in which, at the other end, the bottoms of the incline-decline sections of the main and follower channels, respectively, define horizontally spaced bottom points.

15. Conveyor elevator apparatus as claimed in claim 1 and in which at least a further similar apparatus is stacked below the first-named apparatus.

16. Conveyor elevator apparatus as claimed in claim 15 and in which said further apparatus is oriented substantially orthogonally to the first-named apparatus.

* * * * *